US009285740B2

(12) United States Patent
Kokomoto et al.

(10) Patent No.: US 9,285,740 B2
(45) Date of Patent: Mar. 15, 2016

(54) IMAGE FORMING APPARATUS PERFORMING STABILIZATION ON IMAGE DATA

(71) Applicant: KYOCERA Document Solutions Inc., Osaka (JP)

(72) Inventors: Mari Kokomoto, Osaka (JP); Hideo Tanii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/680,926

(22) Filed: Apr. 7, 2015

(65) Prior Publication Data

US 2015/0301489 A1 Oct. 22, 2015

(30) Foreign Application Priority Data

Apr. 21, 2014 (JP) ..... 2014-087372

(51) Int. Cl.
*G03G 15/00* (2006.01)

(52) U.S. Cl.
CPC ..... *G03G 15/50* (2013.01); *G03G 15/505* (2013.01); *G03G 15/6544* (2013.01); *G03G 2215/00827* (2013.01); *G03G 2215/0132* (2013.01)

(58) Field of Classification Search
CPC ..... G03G 15/50; G03G 15/55
See application file for complete search history.

(56) References Cited

U.S. PATENT DOCUMENTS

2007/0134012 A1* 6/2007 Suzuki et al. ..... 399/49
2009/0129802 A1* 5/2009 Yasukawa ..... 399/53

FOREIGN PATENT DOCUMENTS

JP 2009-122150 A 6/2009

* cited by examiner

*Primary Examiner* — Sandra Brase
(74) *Attorney, Agent, or Firm* — Studebaker & Brackett PC

(57) ABSTRACT

An image forming section forms a printed image on paper based on image data. A post-printing processing section performs post-printing processing on the paper. A stabilization section performs stabilization on image data. A sheet interval detection section detects a sheet interval between consecutive sheets being conveyed in the post-printing processing section. A sheet interval determination section determines whether or not the sheet interval exceeds a reference period of time. A cumulative time measuring section measures a cumulative total time of an image formation operation. A time determination section determines whether or not the cumulative total time exceeds a predetermined period of time. A control section controls, upon determination that the cumulative total time exceeds the predetermined period of time and the sheet interval exceeds the reference period of time, the stabilization section to perform the stabilization during the sheet interval exceeding the reference period of time.

7 Claims, 4 Drawing Sheets

IMAGE FORMING APPARATUS PERFORMING STABILIZATION ON IMAGE DATA

INCORPORATION BY REFERENCE

The present application claims priority under 35 U.S.C. §119 to Japanese Patent Application No. 2014-087372, filed Apr. 21, 2014. The contents of this application are incorporated herein by reference in their entirety.

BACKGROUND

The present disclosure relates to an image forming apparatus. More particularly, the present disclosure relates to a technique for performing stabilization on an image.

General image forming apparatuses perform stabilization on image data in order to achieve a high-quality image. The stabilization is to perform calibration (color density adjustment) on image data according to change in the environment within the image forming apparatus and/or frequency of use of the image forming apparatus, for example. Accordingly, image formation processes are adjusted to be optimal.

For example, some image forming apparatus are capable of appropriate image stabilization. Such image forming apparatuses include a calculating section. The calculating section calculates, upon detecting disturbance during an electrophotographic process, a breakdown for the operating time of their image forming unit on the assumption that image stabilization control has been performed.

Based on the calculation result, it is verified whether or not the ratio of the time taken to perform the stabilization control to the cumulative total of the operating time is equal to or less than a predetermined ratio. If the ratio of the time taken to perform the stabilization control to the cumulative total of the operating time is equal to or less than the predetermined ratio, the image stabilization control is performed. On the other hand, when the ratio of the time taken to perform the stabilization control to the cumulative total of the operating time is greater than the predetermined ratio, timing of the stabilization control is changed so that the ratio of the time taken to perform the stabilization control is equal to or less than the predetermined ratio. As a result, control of the image forming unit is completed without performing the stabilization control. The stabilization control is performed in the next or following operation of the image forming unit.

SUMMARY

An image forming apparatus according to an aspect of the present disclosure includes an image forming section, a post-printing processing section, a stabilization section, a sheet interval detection section, a sheet interval determination section, a cumulative time measuring section, a time determination section, and a control section. The image forming section forms a printed image on paper based on image data. The post-printing processing section performs post-printing processing on the paper or an original document. The stabilization section performs stabilization on image data. The sheet interval detection section detects as a sheet interval a time interval between a trailing end of a preceding sheet of paper and a leading end of a following sheet of paper among consecutive sheets of paper being conveyed in the post-printing processing section or a time interval between a trailing end of a preceding original document sheet and a leading end of a following original document sheet among consecutive original document sheets being conveyed in the post-printing processing section while the post-printing processing section is performing the post-printing processing. The sheet interval determination section determines whether or not the sheet interval detected by the sheet interval detection section exceeds a reference period of time. The cumulative time measuring section measures a cumulative total time of an image formation operation performed by the image forming section. The time determination section determines whether or not the cumulative total time measured by the cumulative time measuring section exceeds a predetermined period of time. Upon the time determination section determining that the cumulative total time exceeds the predetermined period of time and the sheet interval determination section determining that the sheet interval exceeds the reference period of time, the control section controls the stabilization section to perform the stabilization during the sheet interval determined to be exceeding the reference period of time.

DETAILED DESCRIPTION

Figure 1:
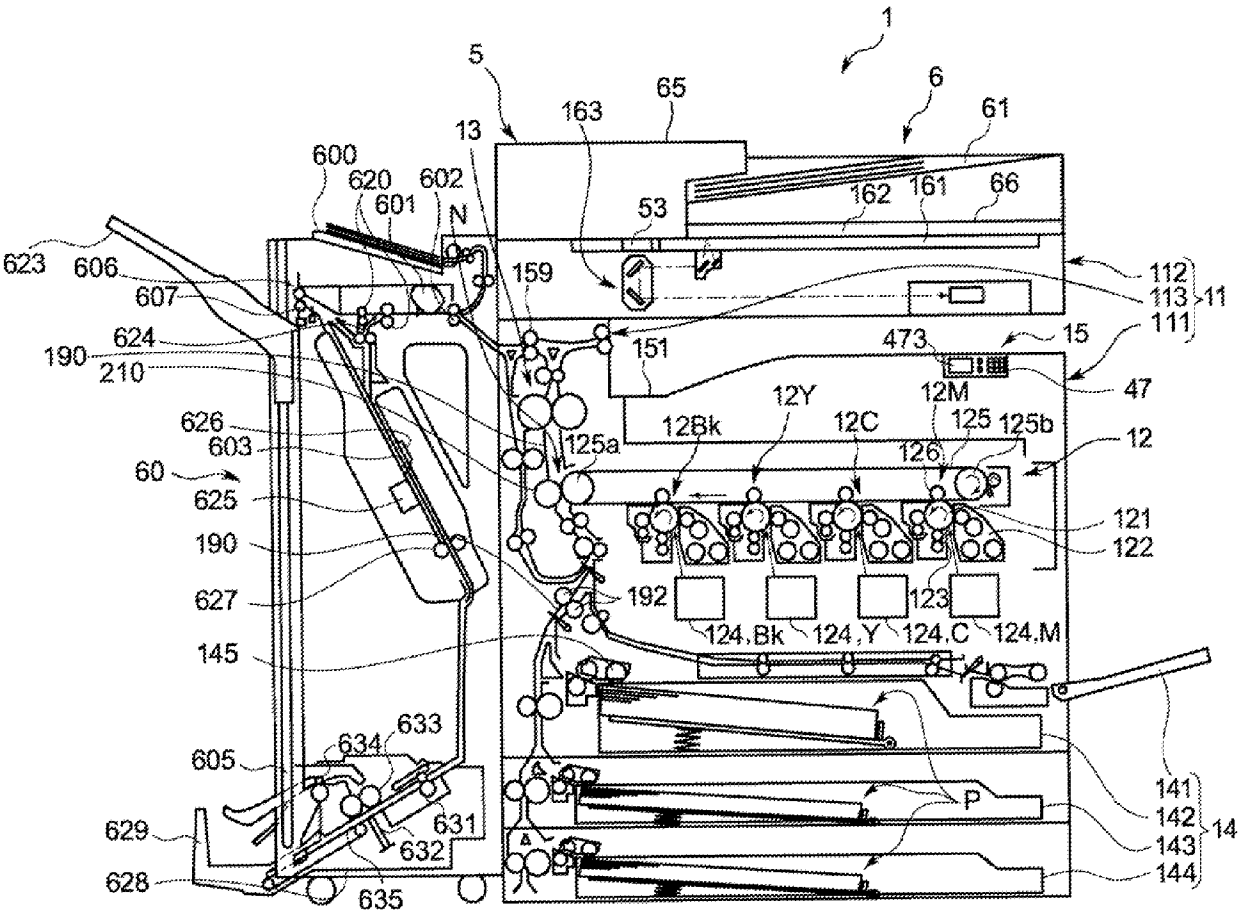
FIG. 1 is a front cross sectional view illustrating a structure of an image forming apparatus according to an embodiment of the present disclosure.

Hereinafter, an image forming apparatus according to an embodiment of the present disclosure will be described with reference to the accompanying drawings. FIG. 1 is a diagram illustrating a structure of an image forming apparatus according to the embodiment of the present disclosure.

An image forming apparatus 1 according to the embodiment of the present disclosure has a function such as a copy function, a printer function, a scanner function, or a facsimile function, for example. The image forming apparatus 1 may be a multifunction peripheral. In this case, the image forming apparatus 1 has at least two or more functions of a copy function, a printer function, a scanner function, and a facsimile function, for example. The image forming apparatus 1 includes a main body 11, an image forming section 12, a fixing section 13, a paper feed section 14, a paper ejection section 15, a document conveyance section 6, a document reading section 5, and so on. The image forming apparatus 1 further includes a post-printing processing device 60. The post-printing processing device 60 is an example of the post-printing processing section recited in the appended claims.

The main body 11 includes a lower body 111, an upper body 112, and a coupling section 113. The upper body 112 is disposed above the lower body 111, facing the lower body 111. The coupling section 113 is disposed between the upper body 112 and the lower body 111. The coupling section 113 couples the lower body 111 and the upper body 112 together with the paper ejecting section 15 between the lower body 111 and the upper body 112. The upper body 112 is supported on an upper end of the coupling section 113. The upper body 112 includes the document reading section 5 and the document conveyance section 6.

The document reading section 5 includes a contact glass 161, a platen cover 162, and a reading mechanism 163. The contact glass 161 is attached to an upper surface of the upper body 112. The platen cover 162 is openable and closable, and presses an original document placed on the contact glass 161. The reading mechanism 163 optically reads an image on an original document placed on the contact glass 161 and generates image data using a charge coupled device (CCD).

The document conveyance section 6 includes a document table 61, a document ejection section 66, and a document conveying mechanism 65. An original document is placed on the document table 61. An original document from which an image has been read is ejected onto the document ejection section 66. The document conveying mechanism 65 includes a sheet feed roller, a conveyance roller, and a sheet reversing mechanism, not shown. The document conveying mechanism 65 picks up original document sheets placed on the document table 61 one by one using the sheet feed roller and conveys the original document sheets to a position opposite to a document reading slit 53 using the conveyance roller. The reading mechanism 163 reads an image on the original document through the document reading slit 53. Thereafter, the original document sheets are ejected onto the document ejection section 66.

The document conveyance section 6 is rotatably attached to the upper body 112 so that a front side of a document conveyance section 6 in FIG. 1 can move upward. A user can place an original document to be read on a top surface of the contact glass 161 serving as a platen by moving the front side of the document conveyance section 6 upward and thus uncovering the top surface of the contact glass 161. The original document to be read is for example a folded-open book.

The lower body 111 includes the image forming section 12, the fixing section 13, and the paper feed section 14. The paper feed section 14 has a manual feed tray 141 and paper feed cassettes 142, 143, and 144. The manual feed tray 141 is disposed to be openable and closable in a lower location of a right side wall of the main body 11 in FIG. 1. The manual feed tray 141 is a tray from which paper P is manually fed toward the image forming section 12. The paper feed cassettes 142, 143, and 144 are detachably attached to the main body 11 in locations lower than exposure devices 124 in the lower body 111. The paper feed cassettes 142, 143, and 144 each contain a stack of paper including a plurality of sheets of paper P.

Pickup rollers 145 are disposed above the respective paper feed cassettes 142, 143, and 144. Each of the pickup rollers 145 picks up and sends toward a sheet conveyance path 190 a topmost sheet of paper P out of the stack of paper contained in the paper feed cassettes 142, 143, and 144.

In an image formation operation by the image forming apparatus 1, the image forming section 12 forms a printed image on a paper P fed from the paper feed section 14 based on image data generated through the above-described document reading or on image data stored in an internal HDD. Image forming units 12M, 12C, 12Y, and 12Bk of the image forming section 12 each include a photosensitive drum 121, a charger 123, the exposure device 124, the developing device 122, and a primary transfer roller 126.

The developing devices 122 of the image forming units 12M, 12C, 12Y, and 12Bk each contain toner for developing an electrostatic latent image. Each developing device 122 supplies the toner to a surface of the corresponding photosensitive drum 121 charged by the charger 123 and exposed to light by the exposure device 124.

In the case of color printing, the image forming unit 12M for a magenta color, the image forming unit 12C for a cyan color, the image forming unit 12Y for a yellow color, and the image forming unit 12Bk for a black color of the image forming section 12 perform charging, light exposure, and development based on image data formed from components of the respective colors. Thus, a toner image is formed on a surface of each photosensitive drum 121. The primary transfer rollers 126 transfer the toner images onto an intermediate transfer belt 125.

The intermediate transfer belt 125 stretches between a drive roller 125*a* and a driven roller 125*b*. An outer circumferential surface of the intermediate transfer belt 125 functions as an image bearing surface onto which toner images are transferred. The intermediate transfer belt 125 is rotated by the drive roller 125*a* while in contact with peripheral surfaces of the respective photosensitive drums 121. The intermediate transfer belt 125 is endless and travels between the drive roller 125*a* and the driven roller 125*b* in synchronization with the respective photosensitive drums 121.

The toner images of the respective colors are transferred onto the intermediate transfer belt 125 in a timed manner. The toner images of the respective colors are superimposed on the intermediate transfer belt 125 to be a color toner image. A secondary transfer roller 210 and the drive roller 125*a* form a nip section N with the intermediate transfer belt 125 therebetween. The secondary transfer roller 210 transfers the color toner image formed on the intermediate transfer belt 125 onto paper P conveyed to the nip section N from the paper feed section 14 through the conveyance path 190. Thereafter, the fixing section 13 fixes the color toner image transferred onto the paper P by thermocompression bonding. The paper P on which the color image has been formed through the fixing is ejected onto an exit tray 151.

The paper ejection section 15 is formed between the lower body 111 and the upper body 112. The paper ejection section 15 includes the exit tray 151 formed on a top surface of the lower body 111. Paper P that has gone through the toner image formation in the image forming section 12 and the fixing in the fixing section 13 is ejected onto the exit tray 151.

The post-printing processing device 60 includes a document table 600, a punch section 601, a pair of conveyance rollers 602, a sheet cradle 603, a pair of conveyance rollers 620, a pair of ejection rollers 607, a sheet exit tray 623, and a conveyance diverging guide 624. The post-printing processing device 60 further includes a stapler 625, a receiving member 626, a pair of conveyance rollers 627, a bookbinding section 628, and an exit tray 629. The post-printing processing device 60 performs post-printing processing on paper P. For example, the post-printing processing device 60 may be a finisher. In post-printing processing that is performed by the finisher, a longer sheet interval is needed. The post-printing processing may be at least one of stapling, punching, sorting, and folding.

An original document on which the post-printing processing device 60 is to perform the post-printing processing is placed on the document table 600. The punch section 601 performs punching on a sheet conveyed thereto by a pair of ejection rollers 159 of the main body 11 or conveyed thereto from the document table 600 (e.g., paper P on which a printed image has been formed or an original document placed on the document table 600). The punching refers to processing for cutting a hole in a sheet conveyed to the punch section 601. The punching needs a halt of sheet conveyance for cutting a hole in a sheet. Accordingly, the punching makes the sheet interval longer. When a plurality of holes are cut in a sheet along the sheet conveyance direction, the sheet conveyance is halted for every hole cutting. Accordingly, the sheet interval is still longer when a plurality of holes are cut in a sheet. The sheet interval refers to a period of time from when a trailing end of a preceding sheet of paper P passes a predetermined point to when a leading end of a following sheet of paper P passes the predetermined point. The sheet cradle 603 temporarily holds paper or an original document conveyed thereto by the pairs of conveyance rollers 602 and 620. When a plurality of sheets of paper or a plurality of original document sheets are conveyed, they are held by the sheet cradle 603 in a stack.

The pair of ejection rollers 607 is disposed at a sheet exit slot 606 through which paper conveyed from the post-printing processing device 60 is ejected. The pair of ejection rollers 607 ejects paper conveyed thereto from the pairs of conveyance rollers 602 and 620, and paper conveyed thereto from the sheet cradle 603 onto the sheet exit tray 623. A lifter 605 goes up and down to lift up and down the sheet exit tray 623. The sheet exit tray 623 receives, at a sheet receiving position in the vicinity of the sheet exit slot 606, paper ejected by the pair of ejection rollers 607 through the sheet exit slot 606. Paper ejected through the sheet exit slot 606 is placed on the sheet exit tray 623.

The stapler 625 performs stapling on sheets of paper conveyed to the sheet cradle 603. The stapling is to staple sheets of paper and eject a stack of paper. Ejection of a stack of paper takes more time than ejection of unprocessed paper does, making the sheet interval longer. The receiving member 626 receives and holds a lower end of paper conveyed to the sheet cradle 603. The pair of conveyance rollers 627 conveys paper downward from the sheet cradle 603. The bookbinding section 628 performs folding on paper conveyed thereto from the pair of conveyance rollers 627. Folded paper is ejected onto the exit tray 629. Folding is to center-fold and bind sheets of paper into a booklet, and then eject the booklet. Ejection of a booklet takes more time than ejection of unprocessed paper does, making the sheet interval longer.

The sheet cradle 603 includes a drive section (not shown) that moves the receiving member 626 in the sheet conveyance direction. The drive section is driven in accordance with a control signal from a drive control section (not shown). As a result, paper held by the receiving member 626 is conveyed to the pair of ejection rollers 607. The paper conveyed by the pair of ejection rollers 607 is ejected onto the sheet exit tray 623 through the sheet exit slot 606.

The stapler 625 is movable in accordance with the drive section. The drive section is driven in accordance with a control signal from the drive control section. In performing normal stapling on paper conveyed to the sheet cradle 603, the stapler 625 is moved to a position close to an end of paper and staples the paper at the position close to the end. In performing bookbinding on paper, the stapler 625 is moved to a position close to a center of the paper and staples the paper at the position close to the center for saddle stitch.

The bookbinding section 628 includes a center-stapled sheet table 635, a pair of conveyance rollers 631, a pushing member 632, a pair of center-folding rollers 633, and a pair of ejection rollers 634. Paper center-stapled by the stapler 625 is placed on the center-stapled sheet table 635. The pair of conveyance rollers 631 conveys paper conveyed thereto from the pair of conveyance rollers 627 to the center-stapled sheet table 635. The pushing member 632 and the pair of center-folding rollers 633 are disposed opposite to each other, having the center and the vicinity thereof of the paper on the center-stapled sheet table 635 therebetween in such a manner that the former is in contact with one side of the paper and the latter is in contact with the other side of the paper. The pair of center-folding rollers 633 center-folds the paper into a saddle-stitched booklet, and the pair of ejection rollers 634 ejects the booklet onto the exit tray 629.

The lifter 605 includes two pulleys, a belt, and a guide section, not shown. The two pulleys are rotated by drive force given by a drive source (not shown). The belt stretches between the two pulleys and rotates with the rotation of the pulleys. The guide section moves the sheet exit tray 623 upward and downward along a direction of the rotation of the belt. A side of the sheet exit tray 623 is attached to the belt. The drive control section controls the drive source to cause the lifter 605 to lift up or down the sheet exit tray 623.

The image forming apparatus 1 allows an operator to configure settings for various types of processing by inputting operation directions through the later-described operation section 47 of the image forming apparatus 1. The settings for various types of processing refer to a setting for performing the post-printing processing on paper, a setting for performing the bookbinding processing on paper having a printed image transferred thereto, and the like.

Figure 2:
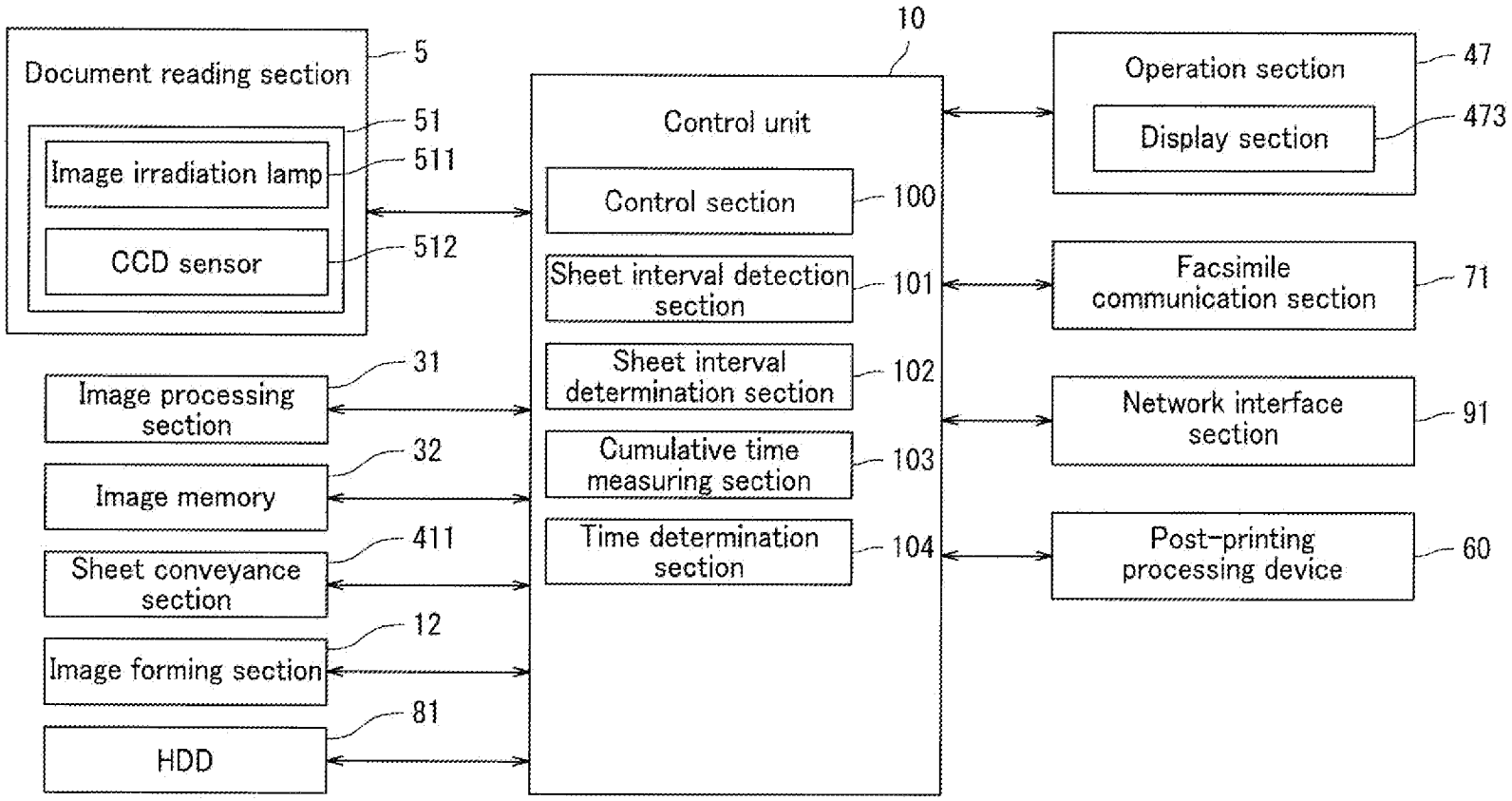
FIG. 2 is a functional block diagram illustrating internal configuration of the image forming apparatus.

Next, electrical configuration of the image forming apparatus 1 including the post-printing processing device 60 will be described. FIG. 2 is a functional block diagram illustrating internal configuration of the image forming apparatus 1.

The image forming apparatus 1 includes the document reading section 5, a control unit 10, an image processing section 31, an image memory 32, a sheet conveyance section 411, the image forming section 12, an operation section 47, the post-printing processing device 60, a facsimile communication section 71, a network interface section 91, a hard disk drive (HDD) 81, and so on.

The document reading section 5 has a scanner section 51 including the above-described reading mechanism 163. The reading mechanism 163 includes an image irradiation lamp 511 and a CCD sensor 512. The document reading section 5 reads an image of an original document from the original document by irradiating the original document with light using the image irradiation lamp 511 and receiving light reflected off the original document using the CCD sensor 512.

The image processing section 31 performs image processing as needed according to image data of the image of the original document read by the document reading section 5. The image processing section 31 is an example of the stabilization section recited in the appended claims. For example, the image processing section 31 performs the stabilization on image data for quality improvement in a printed image to be formed on paper by the image forming section 12. The image stabilization is performed on image data to maintain the quality of a printed image to be formed by the image forming section 12. The image stabilization on image data is for example calibration. The image forming section 12 herein forms an image of an original document read by the document reading section 5 on paper. Image data that has gone through the stabilization by the image processing section 31 is stored in the image memory 32 or output to another section such as the image forming section 12 or the facsimile communication section 71.

The image memory 32 stores therein image data and the like of an original document read by the document reading section 5.

The sheet conveyance section 411 includes the pickup rollers 145, a pair of conveyance rollers 192, and so on illustrated in FIG. 1. The sheet conveyance section 411 conveys the paper P loaded on the manual feed tray 141, or in the paper feed cassette 142, 143, or 144 to the image forming section 12, the pair of ejection rollers 607 leading to the post-printing processing device 60, and the sheet exit slot 606.

As described above, the image forming section 12 includes: the image forming units 12M, 12C, 12Y, and 12Bk; the intermediate transfer belt 125 stretching between the drive roller 125*a* and the driven roller 125*b*; and the secondary transfer roller 210. Image data to be output to the image forming section 12 may be for example image data read by the document reading section 5 and image data sent from a client computer or the like within a local area network through the network interface 91. In the description made with reference to FIG. 2, the image forming section 12 includes the fixing section 13. The image forming section 12 is an example of the image forming section recited in the appended claims.

As shown in FIG. 1 as well as in FIG. 2, the operation section 47 includes a touch panel section and an operation key section. The touch panel section and the operation key section receive directions from a user regarding various types of operations and processing that can be executed by the image forming apparatus 1. The touch panel section includes a display section 473 such as a liquid crystal display (LCD) with a touch panel.

The facsimile communication section 71 includes an encoding/decoding section, a modulation/demodulation section, and a network control unit (NCU), not shown. The facsimile communication section 71 receives and sends facsimiles through a public switched telephone network. For example, the facsimile communication section 71 sends image data of an original document read by the document reading section 5 to a facsimile machine or receives image data sent from a facsimile machine through the public switched telephone network.

The HDD 81 stores therein image data and the like of an original document read by the document reading section 5. The image data stored in the HDD 81 is formed into a printed image on paper by the image forming section 12. The image data stored in the HDD 81 can be sent to a client computer network-connected to the image forming apparatus 1.

The network interface section 91 includes a communication module such as a LAN card. The network interface section 91 receives and sends various types of data from and to a device (e.g., a personal computer) in a local area network through a LAN connected to the network interface section 91.

The control unit 10 includes a central processing unit (CPU), RAM, ROM, dedicated hardware circuitry, and so on. The control unit 10 performs overall control of the image forming apparatus 1. The control unit 10 includes a control section 100, a sheet interval detection section 101, a sheet interval determination section 102, a cumulative time measuring section 103, and a time determination section 104.

The control section 100 is connected with the document reading section 5, the image processing section 31, the image memory 32, the sheet conveyance section 411, the image forming section 12, the operation section 47, the post-printing processing device 60, the facsimile communication section 71, the network interface section 91, and the HDD 81, and performs control of these sections.

The sheet interval detection section 101 detects the sheet interval while the post-printing processing device 60 is performing post-printing processing. The sheet interval refers to a time interval between a trailing end of a preceding sheet of paper P and a leading end of a following sheet of paper P among consecutive sheets of paper P being conveyed in the post-printing processing device 60. The sheet interval may be a time interval between a trailing end of a preceding original document sheet and a leading end of a following original document sheet among consecutive original document sheets being conveyed.

The sheet interval determination section 102 determines whether or not the sheet interval detected by the sheet interval detection section 101 exceeds a reference period of time.

The cumulative time measuring section 103 measures the cumulative total time taken for the image forming section 12 to perform an image formation operation.

The time determination section 104 determines whether or not the cumulative total time measured by the cumulative time measuring section 103 exceeds a predetermined period of time.

When the time determination section 104 determines that the cumulative total time exceeds the predetermined period of time and the sheet interval determination section 102 determines that the sheet interval exceeds the reference period of time, the control section 100 controls the image processing section 31 to perform the stabilization during the sheet interval determined to be exceeding the reference period of time.

The image forming apparatus 1 according to an embodiment of the present disclosure includes the control section 100, the sheet interval detection section 101, the sheet interval determination section 102, the cumulative time measuring section 103, and the time determination section 104.

The control unit 10 operates in accordance with an image processing program installed in the HDD 81 to function as the control section 100, the sheet interval detection section 101, the sheet interval determination section 102, the cumulative time measuring section 103, or the time determination section 104. Alternatively, the control section 100, the sheet interval detection section 101, the sheet interval determination section 102, the cumulative time measuring section 103, and the time determination section 104 may each include hard-wired circuitry, being independent from the operation of the control unit 10 in accordance with the image processing program. The same is true of the following embodiments unless otherwise noted.

Figure 3:
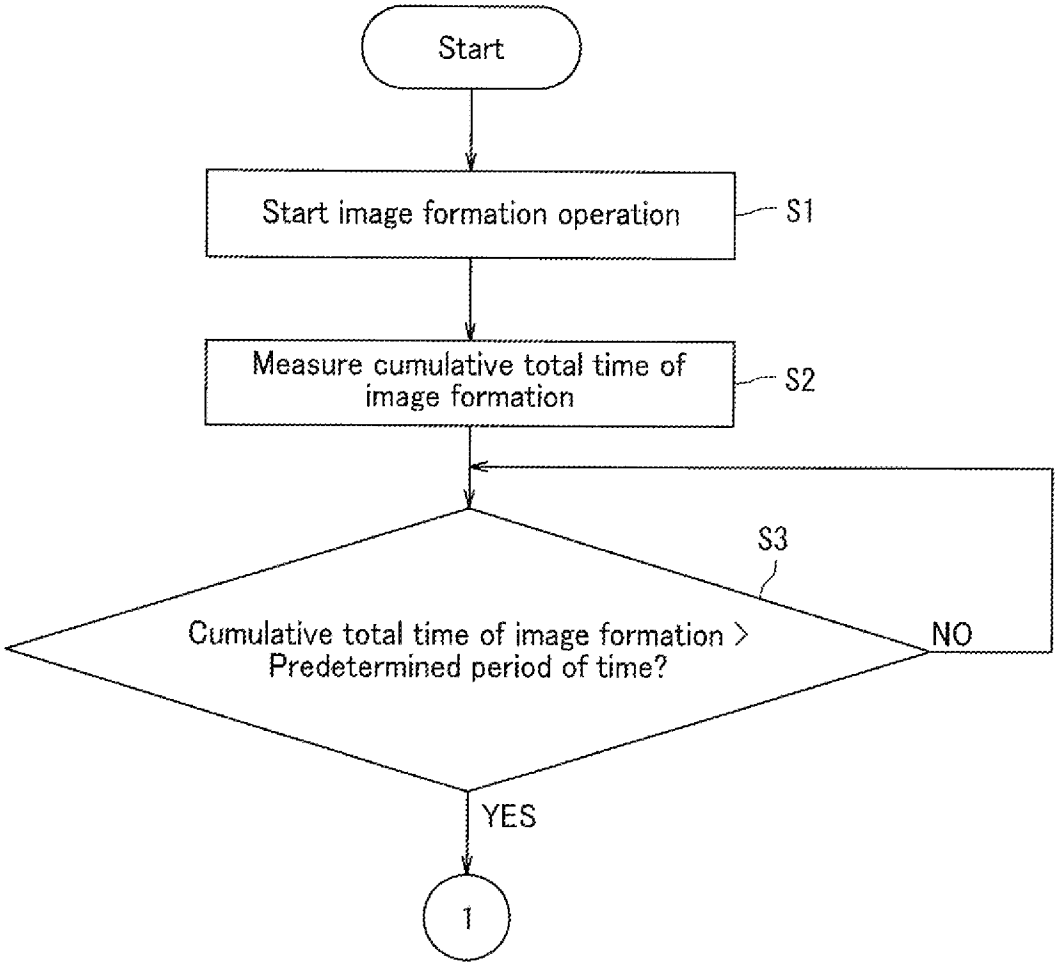
FIG. 3 is a flowchart illustrating a first half of stabilization control based on a sheet interval of sheets of paper conveyed to a post-printing processing device.
Figure 4:
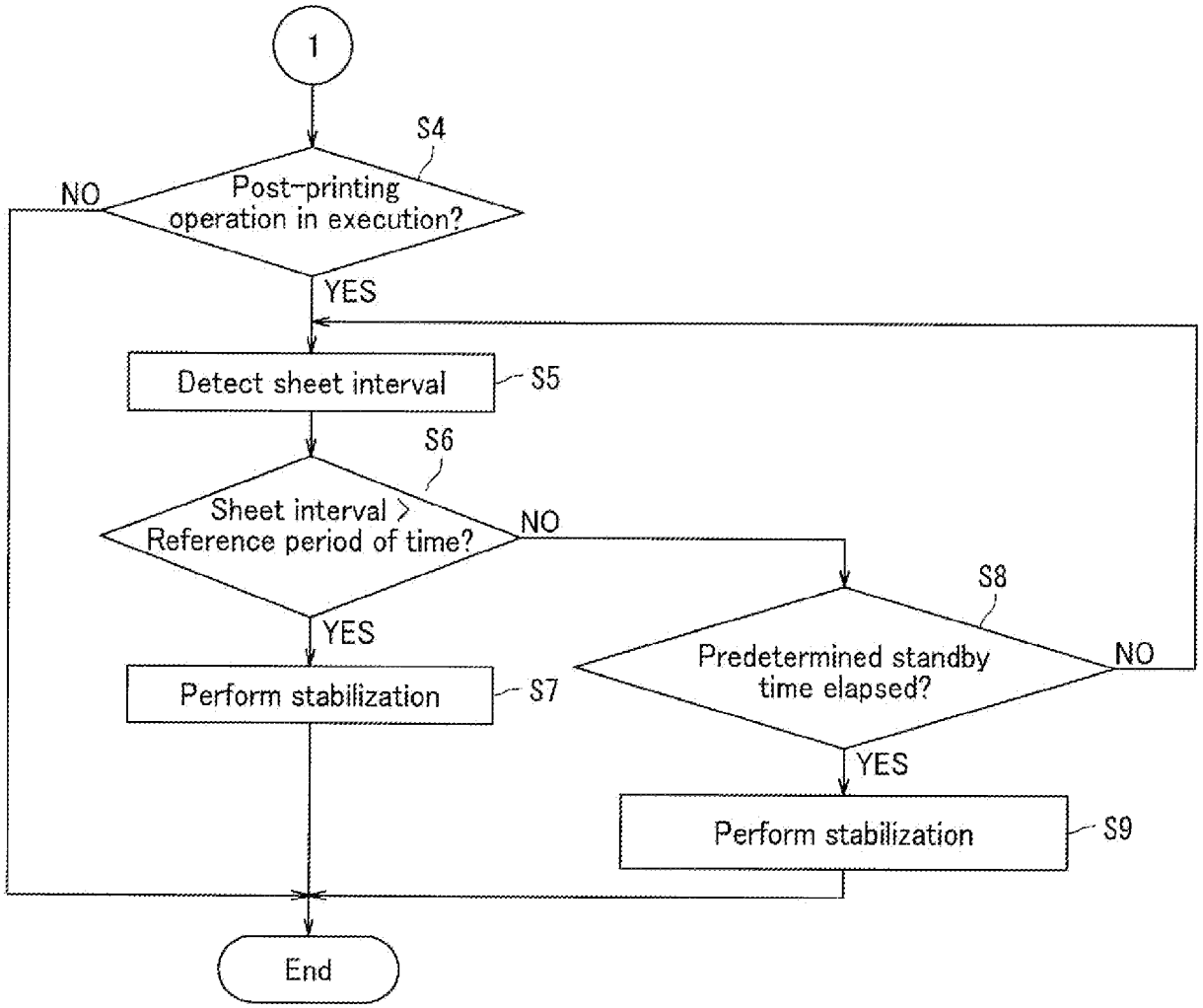
FIG. 4 is a flowchart illustrating a last half of the stabilization control based on the sheet interval of sheets of paper conveyed to the post-printing processing device.

Next, the stabilization control in the image forming apparatus 1 including the post-printing processing device 60 will be described with reference to FIGS. 3 and 4. FIG. 3 is a flowchart illustrating a first half of the stabilization control based on the sheet interval of a plurality of sheets of paper P conveyed to the post-printing processing device 60. FIG. 4 is a flowchart illustrating a last half of the stabilization control based on the sheet interval of a plurality of sheets of paper P conveyed to the post-printing processing device 60.

The stabilization is triggered by the image formation time taken for the image forming section 12 to perform an image formation operation. In this control, once the image forming section 12 has started the image formation operation (51), the cumulative time measuring section 103 starts measuring the cumulative total of the time taken for the image forming section 12 to perform the image formation operation (S2). The cumulative time measuring section 103 accumulates developer actuation time in this control. The developer actuation time refers to a period of time during which the developing device 122 is actuated.

The time determination section 104 determines whether or not the cumulative total time measured by the cumulative time measuring section 103 exceeds a predetermined period of time (e.g., five minutes) (S3). When the time determination section 104 determines that the cumulative total time does not exceed the predetermined period of time (No in S3), then the time determination section 104 repeats the determination in S3. That is, the time determination section 104 determines again whether or not the cumulative total time exceeds the predetermined period of time. On the other hand, when the time determination section 104 determines that the cumulative total time exceeds the predetermined period of time (Yes in S3), then the control section 100 determines whether or not the post-printing processing device 60 is performing post-printing processing (S4).

When the control section 100 determines that the post-printing processing device 60 is not performing post-printing processing (No in S4), then the stabilization control of the present embodiment is completed. That is, when the control section 100 determines that the post-printing processing device 60 is not performing post-printing processing, the image processing section 31 does not perform the stabilization. On the other hand, when the control section 100 determines that the post-printing processing device 60 is performing post-printing processing (Yes in S4), then the sheet interval detection section 101 detects the sheet interval (S5). In the present embodiment, the image forming apparatus 1 has a plurality of read sensors located upstream of the pair of conveyance rollers 602 in terms of the sheet conveyance direction and disposed along the conveyance path of paper that is conveyed by the post-printing processing device 60. The sheet interval detection section 101 detects as the sheet interval a time interval between two consecutive sheets of paper being conveyed, that is, a period of time from when a trailing end of the preceding sheet of paper among the two consecutive sheets of paper passes a reading point of each read sensor till when a leading end of the following sheet of paper passes the reading point of the read sensor (detection of the sheet interval).

Next, the sheet interval determination section 102 determines whether or not the sheet interval detected by the sheet interval detection section 101 exceeds a reference period of time (S6). The reference period of time is a period of time predetermined as a time needed for the stabilization. When the sheet interval determination section 102 determines that the sheet interval exceeds the reference period of time (Yes in S6), then the control section 100 controls the image processing section 31 to perform the stabilization during the sheet interval (S7). Then, the stabilization control of the present embodiment is completed. Herein, among the post-printing processing, the post-printing processing during which the sheet interval exceeds the reference period of time is at least one of stapling, punching, sorting, and folding, for example.

On the other hand, when the sheet interval determination section 102 determines that the sheet interval does not exceed the reference period of time (No in S6), then the control section 100 determines whether or not a predetermined standby time (e.g., one minute) has elapsed (S8). The standby time is set as a period of time during which the image processing section 31 is controlled not to perform the stabilization until the sheet interval exceeds the reference period of time instead of immediately performing the stabilization when it is determined that the cumulative total time exceeds the predetermined period of time (Yes in S3) and it is determined that the post-printing processing device 60 is performing post-printing processing (Yes in S4).

When the control section 100 determines that the predetermined standby time has not elapsed (No in S8), then the stabilization proceeds to S5. That is, when the sheet interval does not exceed the reference period of time, the control section 100 controls the image processing section 31 not to perform the stabilization until the predetermined standby time has elapsed. That is, the control section 100 controls the image processing section 31 not to perform the stabilization until the sheet interval exceeds the reference period of time. On the other hand, upon determining that the predetermined standby time has elapsed (Yes in S8), the control section 100 controls the image forming section 12 to stop the image formation operation and controls the image processing section 31 to perform the stabilization (S9). Then, the stabilization control of the present embodiment is completed.

According to the present embodiment, the stabilization by the image processing section 31 is timed so as to be performed during a period of time during which the post-printing processing device 60 is performing post-printing processing and therefore the sheet interval is long enough for securing time for the stabilization. As a result, spare time of the image forming apparatus 1 that does not contribute to the printing productivity can be effectively used to perform the stabilization on a timely basis without reducing the printing productivity.

According to the present embodiment, the sheet interval determination section 102 determines whether or not the sheet interval detected by the sheet interval detection section 101 exceeds the reference period of time. The time determination section 104 determines whether or not the cumulative total time measured by the cumulative time measuring section 103 exceeds a predetermined period of time. Accordingly, when it is determined that the cumulative total time exceeds the predetermined period of time and it is determined that the sheet interval exceeds the reference period of time, the control section 100 controls the image processing section 31 to perform the stabilization while post-pining processing is being performed.

Furthermore, the present embodiment focuses on an interval between sheets of paper (sheet interval), which gets longer during post-printing processing. When it is determined that the cumulative total time exceeds the predetermined period of time and the sheet interval exceeds the reference period of time during post-printing processing, the control section 100 controls the image processing section 31 to perform the stabilization.

That is, according to the present embodiment, the stabilization is timed so as to be performed during a period of time during which post-printing processing is performed and therefore the sheet interval is long enough for securing time for the stabilization. Accordingly, spare time that does not contribute to the printing productivity can be used effectively. As a result, it is possible to perform the stabilization on a timely basis while preventing reduction in printing productivity.

The stapling, the punching, and the folding have been described as examples of the post-printing processing in the present embodiment. The sorting that involves moving a paper width guide and ejecting sheets of paper into different positions in terms of a direction perpendicular to the sheet conveyance direction can be an example of the post-printing processing. Ejection of paper takes more time in the sorting than in normal printing. Accordingly, a longer interval may be needed between sheets of paper (sheet interval).

Output destination changing in delivering output to a mail box can be an example of the post-printing processing. An image forming apparatus 1 capable of the mailbox delivering has a plurality of trays. The output destination changing involves control to move a distribution guide to change output destinations. When the distance of move of the distribution guide is long (e.g., when the output destination is changed from a tray 1 to a tray 7), the move of the distribution guide may not be completed within a normal sheet interval. In this case, therefore, a longer sheet interval may be needed.

Printing processing including both printing without stapling and printing with stapling can be an example of the post-printing processing. Such printing processing needs the stapler to move from an HP position (where a user can replace stapler cartridges) to a stapler standby position once a job without stapling has been completed and the processing shifts to a job with stapling. In this case, therefore, a longer sheet interval may be needed.

In the present embodiment, an example of the image forming apparatus 1 equipped with the post-printing processing device 60 has been described in which the stabilization is timed so as to be performed during a period of time during which post-printing processing is performed and therefore a sheet interval is long enough. However, the present disclosure is not limited to the example, and in a configuration in which the image forming apparatus 1 is not equipped with the post-printing processing device 60, the stabilization may be timed so as to be performed during switching among the paper feed cassettes 142, 143, and 144 from which the paper P is sent out.

The configuration and the processing described above with reference to FIGS. 1 to 4 are merely an embodiment of the present disclosure. The configuration and the processing of the present disclosure are not limited to the embodiment.

What is claimed is:

1. An image forming apparatus comprising:

an image forming section that forms a printed image on paper based on image data;

a post-printing processing section that performs post-printing processing on the paper or an original document;

a stabilization section that performs stabilization on image data;

a sheet interval detection section that detects as a sheet interval a time interval between a trailing end of a preceding sheet of paper and a leading end of a following sheet of paper among consecutive sheets of paper being conveyed in the post-printing processing section or a time interval between a trailing end of a preceding original document sheet and a leading end of a following original document sheet among consecutive original document sheets being conveyed in the post-printing processing section while the post-printing processing section is performing the post-printing processing;

a sheet interval determination section that determines whether or not the sheet interval detected by the sheet interval detection section exceeds a reference period of time;

a cumulative time measuring section that measures a cumulative total time of an image formation operation performed by the image forming section;

a time determination section that determines whether or not the cumulative total time measured by the cumulative time measuring section exceeds a predetermined period of time; and a control section that controls, upon the time determination section determining that the cumulative total time exceeds the predetermined period of time and the sheet interval determination section determining that the sheet interval exceeds the reference period of time, the stabilization section to perform the stabilization during the sheet interval determined to be exceeding the reference period of time.

2. The image forming apparatus according to claim 1, wherein the control section controls, upon the time determination section determining that the cumulative total time exceeds the predetermined period of time, the stabilization section not to perform the stabilization until a predetermined standby time has elapsed.

3. The image forming apparatus according to claim 2, wherein the control section controls, upon the sheet interval determination section determining that the sheet interval does not exceed the reference period of time and the control section determining that the predetermined standby time has elapsed, the image forming section to stop the image formation operation and the stabilization section to perform the stabilization.

4. The image forming apparatus according to claim 1, wherein among the post-printing processing, the post-printing processing during which the sheet interval exceeds the reference period of time is at least one of stapling, punching, sorting, and folding.

5. The image forming apparatus according to claim 1, wherein the stabilization is calibration.

6. The image forming apparatus according to claim 1, wherein upon determining that the cumulative total time does not exceed the predetermined period of time, the time determination section determines again whether or not the cumulative total time exceeds the predetermined period of time.

7. The image forming apparatus according to claim 1, wherein the control section determines whether or not the post-printing processing section is performing the post-printing processing.

* * * * *